US006105198A

United States Patent [19]

LaCoste

[11] Patent Number: 6,105,198

[45] Date of Patent: Aug. 22, 2000

[54] BLOWER WHEEL BLADE CLEANER FOR AIR CONDITIONERS

[76] Inventor: Marvin LaCoste, P.O. Box 292, Kiln, Miss. 39556

[21] Appl. No.: 09/334,056

[22] Filed: Jun. 15, 1999

Related U.S. Application Data

[60] Provisional application No. 60/089,234, Jun. 15, 1998.

[51] Int. Cl.[7] ..... A47L 13/06; A46B 3/06; A46B 9/02

[52] U.S. Cl. ..... 15/236.06; 15/142; 15/160; 15/169; 15/200; 15/236.08

[58] Field of Search ..... 15/104.001, 142, 15/160, 168–170, 200, 236.01, 236.05–236.09

[56] References Cited

U.S. PATENT DOCUMENTS

| | | | |
|---|---|---|---|
| 1,008,382 | 11/1911 | Sourek | 15/236.06 X |
| 1,764,691 | 6/1930 | Pollack | 15/200 X |
| 1,906,657 | 5/1933 | Stowell | 15/200 X |
| 2,251,626 | 8/1941 | Hertzberg | 15/160 |
| 2,857,607 | 10/1958 | South | 15/169 X |
| 4,244,168 | 1/1981 | Howard | 15/142 X |
| 5,922,139 | 7/1999 | Gilbert | 15/142 X |

FOREIGN PATENT DOCUMENTS

| | | | |
|---|---|---|---|
| 1077562 | 11/1954 | France | 15/236.01 |

*Primary Examiner*—Mark Spisich
*Attorney, Agent, or Firm*—Garvey, Smith, Nehrbass & Doody, LLC

[57] ABSTRACT

An improved blower wheel blade cleaner, which is hand held, and includes a first handle portion for grasping the apparatus, and a second cleaning portion. The cleaning portion comprises a double row of elongated teeth extending outward from the handle portion with the first row terminating in a single plane along the outward edge of the cleaning teeth, and the second row extending adjacent the first row forming a concave V-shape at the end of the first row. There is further provided that the first row of teeth has a slight bend at the end portion of the row, and likewise, the inner row of teeth forming the V-shape likewise having a slight bend in their configuration for use of the tool. There is further provided the fact that the two rows of teeth are secured to the handle portion via soldering or the like, and there may be included a movable tensioner band movable along the lengths of the teeth as the case may be.

6 Claims, 2 Drawing Sheets

BLOWER WHEEL BLADE CLEANER FOR AIR CONDITIONERS

CROSS-REFERENCE TO RELATED APPLICATIONS

Priority of U.S. Provisional Patent Application Ser. No. 60/089,234, filed Jun. 15, 1998, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to air conditioning systems. More particularly, the present invention relates to an improvement in a utensil for cleaning the arcuate blades of blower wheels on air conditioning systems.

2. General Background of the Invention

In the field of air conditioning systems, one of the most important aspects of a properly functioning air conditioning system is to maintain the air conditioning system clean. Therefore, there are various tools and devices which are utilized to make certain that all aspects of the system function properly including the air conditioning coils and the air conditioning blower wheel blades which circulate air out of the system and maintain the system in its coolest functioning order. There is on the market at this time an apparatus which is hand held and which includes a plurality of teeth extending from a handle portion outward, with the teeth serving as a means for inserting between the air conditioning coils and removing dust or debris there between. This apparatus may include a tensioner band which is slidable along the length of the teeth, so as when the band is upward near the end of the teeth, the teeth become more stable as a unit and yet when the band is slid closer to the handle portion, the teeth operate more freely.

When one addresses the cleaning of the arcuate blades of a blower wheel, there is no single tool in the industry which is utilized that can clean the concave surfaces of the plurality blower wheel blades because of the concavity formed by those surfaces, and the inability for a device to fit properly within the concavity of each blade in the wheel. Therefore, there is a need in the industry for such a device which would accomplish this task quite easily.

BRIEF SUMMARY OF THE INVENTION

The apparatus of the present invention solves the shortcoming in the art in a simple and straightforward manner. What is provided is an improved blower wheel blade cleaner, which is hand held, and includes a first handle portion for grasping the apparatus, and a second cleaning portion. The cleaning portion comprises a double row of elongated teeth extending outward from the handle portion with the first row terminating in a single plane along the outward edge of the cleaning teeth, and the second row extending adjacent the first row forming a concave V-shape at the end of the first row. There is further provided that the first row of teeth includes a slight bend at the end portion of the row, and likewise, the inner row of teeth forming the V-shape likewise having a slightly greater bend in their configuration for use of the tool, defining a gap between the rows of teeth. There is further provided the fact that the two rows of teeth are secured to the handle portion via soldering or the like, and there may be included a movable tensioner band movable along the lengths of the teeth as the case may be.

Therefore, it is the principal object of the present invention to provide a hand held tool for cleaning blower wheel blades of an air conditioning system blower wheel, by utilizing a double-rowed teeth cleaning portion so that the inner row is allowed to form itself along the entire concave surface of the cleaner blade as the apparatus is pulled along the blade.

It is a further object of the present invention to provide an improved apparatus for cleaning blower blades which allows the cleaning portion of the apparatus to easily form into the shape of the concave cleaner blade and to clean the blade along its entire length.

It is a further object of the present invention to provide an improved blower wheel blade cleaner apparatus which due to a double row of cleaning teeth provide greater flexibility in the cleaning teeth in order to meet the shape of the blower blades along their entire length.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
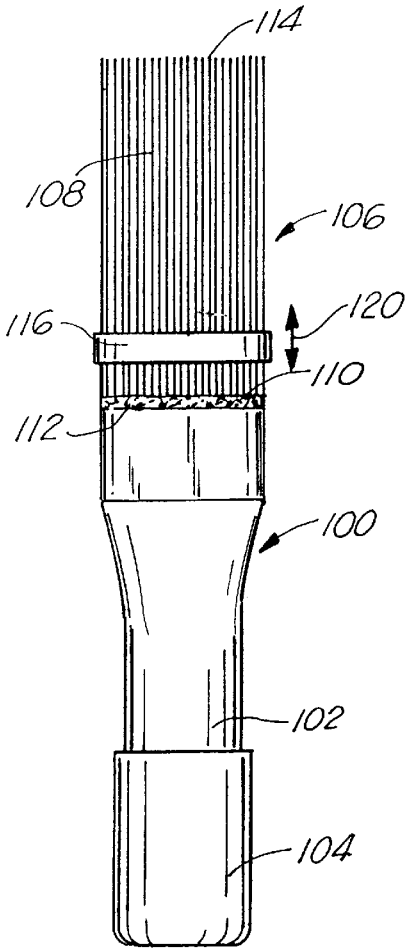
FIG. 1 PRIOR ART
FIGS. 1 and 2 illustrate front and side views, respectively, of a prior art cleaning apparatus for cleaning the spaces between air conditioner compressor coils.

FIGS. 3–6 illustrate the preferred embodiment of the apparatus of the present invention by the numeral 10. Prior to a discussion of apparatus 10, reference is made to FIGS. 1 and 2 which illustrate a prior art apparatus which may have similar features in terms of construction but is utilized for a different purpose. As seen in FIG. 1, there is seen a prior art apparatus which will be labeled apparatus 100 having a handle portion 102 with a cap 104 on its first end and a cleaning portion 106 on its second end. Cleaning portion 106 includes a single row of metal like teeth members 108 which are secured on their first end 110 via a mild soldering or the like 112 and terminating in a single plane 114 on their second end. There is further included a slidable member 116 which slides in the bi-direction of arrow 120 so that the blade members become less or more tense as the apparatus is used. As seen in side view in FIG. 2, each of the teeth members 108 extend along a flat plane for most of their length but at point 122 undergo a slight bend to form a bent finger portion 124. Therefore, when the apparatus is utilized, it is utilized to usually clean the spaces between the various coils in an air conditioning system and the bent finger 124 may enable the fingers to clean more fully completely between each of the coils in the air conditioning system.

Figure 2:
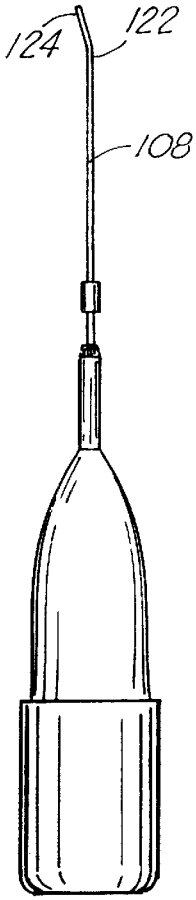
FIG. 2 PRIOR ART

In the present invention, as illustrated in FIGS. 3–6, there is the improved apparatus 10 which is utilized for cleaning a portion of an air conditioning system quite unlike the space between the coils in an air conditioner compressor. The present apparatus would be an apparatus for cleaning primarily the concave surface which is found in each of the blades which form a blower wheel of the air conditioner, the blades totaling a plurality of blades around a complete circular wheel which generate a flow of air to and from the system. The apparatus, although looking somewhat similar to the prior art apparatus in FIGS. 1 and 2, has very important structural differences which enable it to accomplish the task which could not be accomplished by the apparatus as seen in FIGS. 1 and 2.

Figure 3:
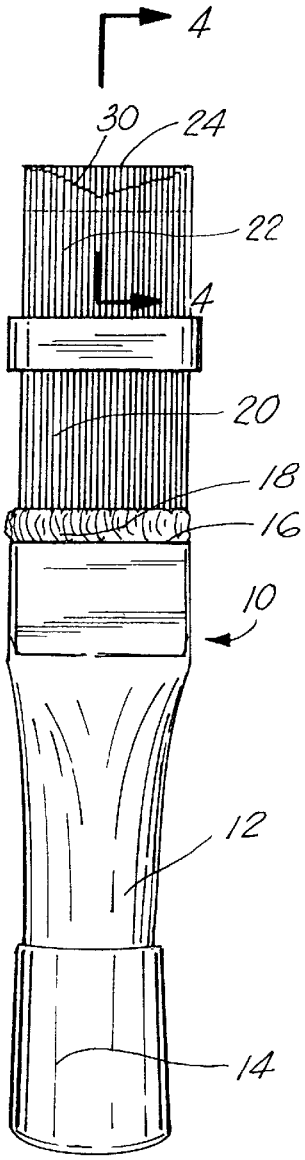
FIG. 3 illustrates an overall view of the improved blower wheel blade cleaner of the present invention.
Figure 4:
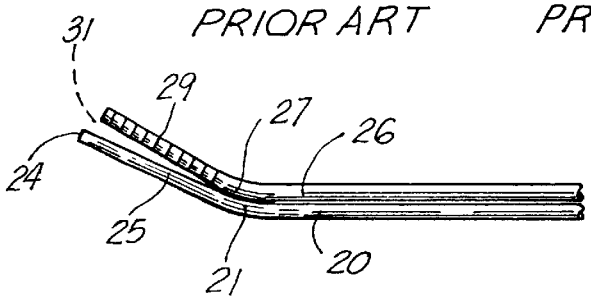
FIG. 4 illustrates a partial view along lines 4—4 of FIG. 3 of the present invention.

Turning now to the construction of apparatus 10, there is seen a handle portion 12 having an end cap 14 on its first end, and terminating at a second end 16 where there is seen a very large bead of solder 18 for securing a plurality of cleaning teeth 20. The cleaning teeth 20 would be found in a configuration which would involve a first or upper row of teeth 22 extending from the solder bead 18 outward to a single plane 24 for forming the upper row of teeth. Further, as seen in FIG. 4 which is a Figure along lines 4—4 in FIG. 3, there is provided an interior set of teeth 26 which run along the length of teeth 20, and are laid thereupon. Therefore, that is the reason why the solder line 18 is rather bulky in that it must secure both rows of teeth firmly so that they may undertake their cleaning function. It should be noted that the interior row of teeth 26 do not terminate in a single flat plane 24 as with the first row 20 but form a concave V-shape 30 as seen in FIG. 3, the reason of which will be explained further. Again, turning now to FIG. 4, the outer row of teeth 20 terminate in their flat length at 21 and then effect a slight bend forming a finger portion 25 along their length to terminate at point 24. Likewise, the interior teeth 26 form a bend at point 27, defining fingers 29. The bend, as seen in FIG. 4, is more pronounced than the bend of outer teeth 20, forming a V-shaped gap 31 between the rows of teeth 20 and 26.

Figure 6:
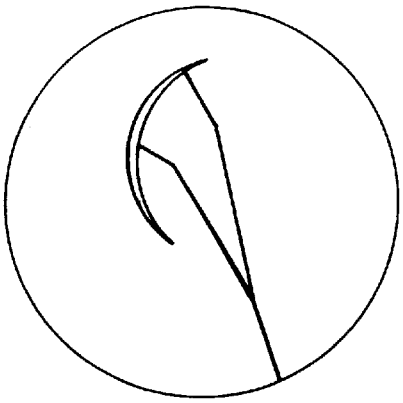
FIG. 6 illustrates an isolated view of the teeth of the apparatus cleaning the blower blades.
Figure 5:
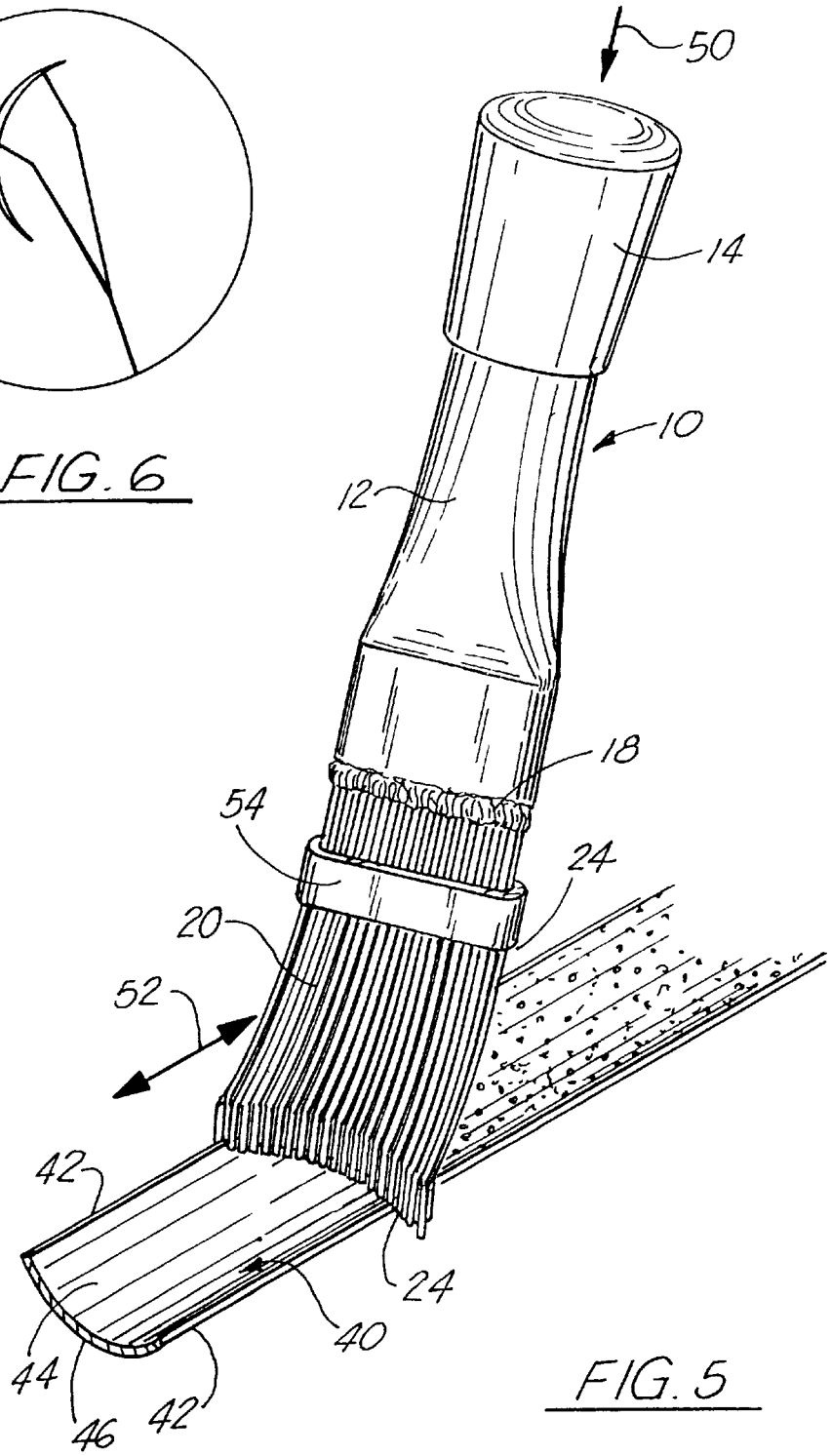
FIG. 5 illustrates an overall view of the apparatus of the present invention as it is utilized cleaning the interior or concave surface of a blower wheel blade.

Turning now to FIGS. 5 and 6, apparatus 10 as the construction of which was explained earlier, is illustrated in the process of cleaning a blower wheel blade 40. Blower wheel blade 40 would be one of many of a plurality of spaced apart blades 40 contained upon a blower wheel of a system, so that there is a pair of edges 42 of the blade and a first inner concave surface 44 and an outer convex surface 46. In the system, each of the blades would be spaced apart to form the continuous plurality of blades around the circular wheel. As seen, apparatus 10 would be of sufficient width so that the rows of teeth 20, 26 would span across the interior surface 44 of the blade 40, and when downward forces placed in the direction of arrow 50 by the holder of the apparatus, the finger portions 29 of the inner row of teeth 26, due to their V-shaped configuration on their end and their more pronounced bend as seen in FIG. 4, would flex downward and would conform to the arcuate surface 44 of blade 40, thus assuring that as the apparatus 10 was moved along in the direction of arrow 52, would clean the entire surface 44 of blade 40 along its entire length. Should one wish to adjust the flexibility of the rows of teeth 20, 26, one would simply slide the slidable collar 54 along the lengths of the teeth and the closer the collar is moved to the ends 24 of the teeth, the less flexible the teeth would become in cleaning. As the collar is moved upward toward the solder bead 18, the teeth become more flexible and able to bend and conform to the surface of the blade 40.

The following is a list of suitable parts and materials for the various elements of the preferred embodiment of the present invention.

PARTS LIST

| DESCRIPTION | PART NO. |
|---|---|
| prior art apparatus | 100 |
| handle portion | 102 |
| cap | 104 |
| cleaning portion | 106 |
| teeth members | 108 |
| first end | 110 |
| soldering | 112 |
| single plane | 114 |
| slidable member | 116 |
| arrow | 120 |
| point | 122 |
| bent finger portion | 124 |
| apparatus | 10 |
| handle portion | 12 |
| end cap | 14 |
| second end | 16 |
| bead of solder | 18 |
| flat length | 21 |
| upper row of teeth | 22 |
| single plane | 24 |
| finger portion | 25 |
| interior set of teeth | 26 |
| point | 27 |
| fingers | 29 |
| concave V-shape | 30 |
| V-shaped gap | 31 |
| blower wheel blades | 40 |
| edges | 42 |
| inner concave surface | 44 |
| outer convex surface | 46 |
| arrow | 50 |
| arrow | 52 |
| slidable collar | 54 |

The foregoing embodiments are presented by way of example only; the scope of the present invention is to be limited only by the following claims.

What is claimed is:

1. An apparatus for cleaning the blades of an air-condition blower wheel having a concave-shaped blower wheel blade, comprising:

a. a handle portion;

b. a blade cleaning portion extending from said handle portion;

c. a first row of elongated teeth comprising a portion of said blade cleaning portion, and terminating in an angulated finger portion;

d. a second row of elongated teeth positioned adjacent said first row, and comprising a portion of said blade cleaning portion, and terminating in an angulated finger portion, the terminating point forming a concave V-shape end; and e. wherein the ends of the first and second row of teeth are adapted to be received by the concave-shaped blower wheel blade, with the second row of teeth flexing to make contact along the entire arcuate surface of the blower wheel blade, for removing debris therefrom as the apparatus is run along the arcuate surface.

2. The apparatus in claim 1, wherein the first row of teeth terminate in a single plane along their end portions.

3. The apparatus in claim 1, wherein the second row of teeth define an angle of bend at the finger portion, greater than the angle of bend of the finger portions of the first row of teeth.

4. The apparatus in claim 1, wherein the first and second row of teeth are secured to the handle portion through soldering.

5. An apparatus for cleaning the blades of an air-condition blower wheel having a concave-shaped blower wheel blade, comprising:

a. a handle portion;

b. a blade cleaning portion extending from said handle portion;

c. a first row of elongated teeth comprising a portion of said blade cleaning portion, and terminating in an angulated finger portion along a single plane;

d. a second row of elongated teeth positioned adjacent said first row, and comprising a portion of said blade cleaning portion, and terminating in an angulated finger portion, the terminating point forming a concave V-shape end; and e. wherein the ends of the first and second row of teeth are adapted to be received by the concave-shaped blower wheel blade, with the second row of teeth flexing to make contact along the entire arcuate surface of the blower wheel blade, for removing debris therefrom as the apparatus is run along the arcuate surface.

6. An improved apparatus for cleaning the blades of an air-condition blower wheel having a concave-shaped blower wheel blade, of the type having a handle portion; a blade cleaning portion extending from said handle portion; and, a first row of elongated teeth comprising a portion of said blade cleaning portion, and terminating in an angulated finger portion along a single plane; the improvement comprising:

a. a second row of elongated teeth positioned adjacent said first row, and comprising a portion of said blade cleaning portion, and terminating in an angulated finger portion, the terminating point forming a concave V-shape end; and b. wherein the ends of the first and second row of teeth are adapted to be received by the concave-shaped blower wheel blade, with the second row of teeth flexing to make contact along the entire arcuate surface of the blower wheel blade, for removing debris therefrom as the apparatus is run along the arcuate surface.

* * * * *